US007261393B2

(12) United States Patent
Miyamoto et al.

(10) Patent No.: US 7,261,393 B2
(45) Date of Patent: Aug. 28, 2007

(54) LIQUID JETTING HEAD, LIQUID JETTING APPARATUS, AND METHOD OF MANUFACTURING THE LIQUID JETTING HEAD

(75) Inventors: Takaaki Miyamoto, Kanagawa (JP); Minoru Kohno, Tokyo (JP); Osamu Tateishi, Nagasaki (JP)

(73) Assignee: Sony Corporation, Tokyo (JP)

( * ) Notice: Subject to any disclaimer, the term of this patent is extended or adjusted under 35 U.S.C. 154(b) by 250 days.

(21) Appl. No.: 10/967,555

(22) Filed: Oct. 18, 2004

(65) Prior Publication Data

US 2005/0174388 A1 Aug. 11, 2005

(30) Foreign Application Priority Data

Oct. 24, 2003 (JP) ..... P2003-364395

(51) Int. Cl.
*B41J 2/05* (2006.01)

(52) U.S. Cl. ..... 347/56; 347/64

(58) Field of Classification Search ..... 347/20, 347/56–59, 61–65, 67
See application file for complete search history.

(56) References Cited

U.S. PATENT DOCUMENTS 5,491,505 A * 2/1996 Suzuki et al. ..... 347/203
5,517,224 A * 5/1996 Kaizu et al. ..... 347/59

* cited by examiner

*Primary Examiner*—Juanita D. Stephens
(74) *Attorney, Agent, or Firm*—Sonnenschein Nath & Rosenthal LLP

(57) ABSTRACT

The present invention relates to a liquid jetting head, a liquid jetting apparatus, and a method of manufacturing the liquid jetting head. The invention can be particularly adopted to an ink jet printer of a thermal system. A treatment for building up a coating type insulating material film and a treatment for substantially removing the insulating material film in the forming regions of heating elements by etching are repeated at least a plurality of times, whereby deterioration of the heating elements can be prevented even in the case where generation of steps is prevented by an SOG film.

3 Claims, 11 Drawing Sheets

LIQUID JETTING HEAD, LIQUID JETTING APPARATUS, AND METHOD OF MANUFACTURING THE LIQUID JETTING HEAD

RELATED APPLICATION DATA

The present application claims priority to Japanese Application(s) No(s). P2003-364395 filed Oct. 24, 2003, which application(s) is/are incorporated herein by reference to the extent permitted by law.

BACKGROUND OF THE INVENTION

The present invention relates to a liquid jetting head, a liquid jetting apparatus, and a method of manufacturing the liquid jetting head.

In recent years, in the field of image processing and the like, there has been an increasing need for transition from monochromic hard copying to color hard copying. Hitherto, there have been proposed such color copying systems as sublimation type thermal transfer system, fusion thermal transfer system, ink jet system, electrophotographic system, and thermal development silver salt system.

Among these systems, the ink jet system is a system in which droplets of a recording liquid (ink) are let fly from nozzles provided in a printer head serving as a liquid jetting head and are adhered to a recording object, thereby forming dots on the recording object. The ink jet system can output high-quality images while using a simple configuration. The ink jet system is classified into electrostatic attraction system, continuous vibration generating system (piezo system), and thermal system, according to the differences in the system for flying the ink droplets from the nozzles.

Among the above systems, the thermal system is a system in which a bubble is generated by local heating of the ink, and the ink is pushed out through a nozzle by the bubble, to fly onto the printing object. The thermal system can print color images while using a simple configuration.

In a printer head based on such a thermal system includes heating elements for heating the ink(s) which are integrally formed on a semiconductor substrate together with a driving circuit composed of a logic integrated circuit for driving the heating elements. This ensures that, in this type of printer head, the heating elements are arranged in a high density so that they can be securely driven.

In other words, in the printer of the thermal system, the heating elements must be arranged in a high density, in order to obtain print results with high image quality. Specifically, in order to obtain print results corresponding to 600 DPI, for example, the heating elements must be arranged at an interval of 42.333 μm. It is extremely difficult to arrange individual driving elements for the heating elements arranged in such a high density. In view of this, in the printer head, switching transistors or the like are formed on the semiconductor substrate and connected to the corresponding heating elements by the integrated circuit technology, and, further, the switching transistors are driven by a driving circuit similarly formed on the semiconductor substrate, whereby the heating elements can be driven easily and securely.

To be more specific, FIG. 11 is a sectional view showing the configuration in the vicinity of a switching transistor in this type of printer head. The printer head 1 has a structure in which device separation regions for insulatingly separating MOS (Metal Oxide Semiconductor) type field effect transistors is formed on a silicon substrate 2, and thereafter the MOS type transistors 3 and the like are formed between the device separation regions, whereby switching transistors served to drive heating elements and a driving circuit for driving the switching transistors are composed of the MOS type transistors formed by a semiconductor production process.

Subsequently, an inter-layer insulation film for insulating the MOS type transistors 3 and the like are laminated, the inter-layer insulation film is then provided with openings (contact holes), and the first layer of wiring pattern 4 and the heating elements are sequentially formed. Here, the heating elements are formed of tantalum (Ta), tantalum nitride (TaNX), or tantalum-aluminum (TaAl). Subsequently, an inter-layer insulation film 5 for insulating the first layer of wiring pattern 4 and the following second layer of wiring pattern from each other and the like are laminated, the inter-layer insulation film 5 is then provided with openings (via holes) to form the second layer of wiring pattern 6, and the heating elements are connected to the MOS type transistors 3 through the two layers of wiring patterns 4, 6. Followingly, an insulating protective layer 7 of silicon nitride ($Si_3N_4$) and an anti-cavitation layer of β-tantalum are sequentially formed on the heating elements.

In the manufacture of the printer head 1, a photosensitive resin material is then applied to the whole surface of the substrate thus provided with the heating elements and the like, and surplus portions of the applied photosensitive resin are removed by exposure and development steps. Further, a nozzle plate formed of a nickel-cobalt alloy (Ni—Co) is adhered to the upper layer of the assembly, whereby ink liquid chambers, ink conduits for introducing the ink into the ink liquid chambers, and nozzles are formed. The printer head 1 has such a configuration that pulses of voltage are impressed on the heating elements by the MOS type transistors 3, to drive the heating elements, thereby letting ink droplets to fly out.

In the printer head 1 configured as above, mere lamination of the component members cannot obviate the generation of steps due to the wiring pattern 4 and the like in the surface of the insulating protective layer 7, and the steps thus generated leads to the development of steps also in the surface of the resin layer formed on the upper side of the insulating protective layer 7, so that a gap is generated between the nozzle sheet adhered to the resin layer and the surface of the resin layer. In the printer head 1, the generation of such a gap may deteriorate the adhesion between the resin layer and the nozzle sheet.

In relation to this, it is considered that the technique disclosed in U.S. Pat. No. 6,450,622 may be applied, to eliminate such steps by an SOG (Spin On Glass) film, whereby the nozzle sheet can be held sufficiently firmly. Here, the SOG film is formed by a method in which a coating type insulating material containing a siloxane component in an alcohol component serving as a solvent is applied to the substrate surface by the spin coating process, to be built up so as to fill the stepped portions, and then the whole surface of the thus built-up insulating material film is etched back by an etching back process using wet etching or dry etching.

However, if the steps are eliminated merely by the SOG film, the problem of deterioration of the heating elements due to the driving of the heating elements would be generated in the printer head 1. Specifically, when the heating elements were driven in the condition where the ink is not held in the ink liquid chambers (so-called no-load driving), it was confirmed that the resistance of the heating elements in the printer head 1 was raised conspicuously and that the surface of the anti-cavitation layer was turned black, as the relevant regions are indicated by broken lines a in FIG. 12.

The example shown in FIG. 12 corresponds to the case where rectangular resistor films 8, 9 were formed side by side with a predetermined spacing therebetween, one-side ends of the resistor films 8, 9 were connected to each other by a wiring pattern 6*a*, and a driving voltage was applied to the other-side ends of the resistor films 8, 9 by wiring patterns 6*b*, 6*c*, whereby a heating element was composed of the series connection of the resistor films 8, 9. In addition, the heating element portion corresponds to the case where the anti-cavitation layer having a film thickness of 200 nm, the insulating protective layer 7 having a film thickness of 300 nm, the heating element having a film thickness of 100 nm, the inter-layer insulation film 5 composed of a silicon oxide film 400 nm in film thickness, the SOG film 450 nm in film thickness, a silicon nitride film 250 nm in film thickness and a silicon oxide film 1130 nm in film thickness, and the like were formed, in this order as viewed from the ink liquid chamber side. In this example, the heating element was driven by a rated driving power of 0.8 W.

Detailed investigation of this point showed that the heat due to the driving of the heating element is transferred to the SOG film, and the SOG film itself is decomposed by the heat, or the solvent component left in the SOG film is librated, whereby the heating element is oxidized or carbonized, leading to a marked increase in resistance.

Incidentally, it is considered that, in relation to the heating element forming location, the SOG film may be selectively removed by, for example, wet etching, whereby the above-mentioned deterioration of the heating element can be prevented. However, the wet etching of the SOG film renders the so-called overhang conspicuous, and the residue upon formation of the second layer of wiring pattern is left at the portion of the overhang, with the result that the wiring pattern or the like is short-circuited due to the residue.

SUMMARY OF THE INVENTION

The present invention has been made in consideration of the above-mentioned circumstances. Accordingly, it is an object of the present invention to provide a liquid jetting head, a liquid jetting apparatus, and a method of manufacturing the liquid jetting head which make it possible to prevent deterioration of heating elements even in the case of preventing the generation of steps by forming an SOG film.

In order to attain the above object, according to one aspect of the present invention, there is provided a liquid jetting head including heating elements for heating a liquid held in a liquid chamber, and semiconductor devices for driving the heating elements. The heating elements and the semiconductor devices are integrally formed on a substrate. A droplet of the liquid is jetted from a predetermined nozzle by driving the heating element by the semiconductor. A part of an inter-layer insulation film disposed on the semiconductor devices is formed of a coating type insulation film. The coating type insulation film is formed by repeating, at least a plurality of times, a treatment for building up a coating type insulating material film by application to the surface of the substrate, and a treatment for substantially removing the coating type insulating material film in a heating element forming region by etching the surface of the substrate.

In accordance with another aspect of the present invention, there is provided a liquid jetting apparatus for supplying an object with droplets jetted from a liquid jetting head. The liquid jetting head includes heating elements for heating a liquid held in a liquid chamber, and semiconductor devices for driving the heating elements. The heating elements and the semiconductor devices are integrally formed on a substrate. The heating elements are driven by the semiconductor devices to heat the liquid held in the liquid chamber, thereby jetting droplets of the liquid through nozzles. A part of an inter-layer insulation film disposed on the semiconductor devices is formed of a coating type insulation film. The coating type insulation film is formed by repeating, at least a plurality of times, a treatment for building up a coating type insulating material film by application to the surface of the substrate, and a treatment for substantially removing the coating type insulating material film in a heating element forming region by etching the surface of the substrate.

In accordance with a further aspect of the present invention, there is provided a method of manufacturing a liquid jetting head including heating elements for heating a liquid held in a liquid chamber, and semiconductor devices for driving the heating elements. The heating elements and the semiconductor devices are integrally formed on a substrate. A droplet of the liquid is jetted from a predetermined nozzle by driving the heating element by the semiconductor device. The method includes the steps of forming a part of an inter-layer insulation film disposed on the semiconductor devices from a coating type insulation film, and forming the coating type insulation film by repeating, at least a plurality of times, a treatment for building up a coating type insulating material film by application to the surface of the substrate, and a treatment for substantially removing the coating type insulating material film in a heating element forming region by etching the surface of the substrate.

According to the one aspect of the present invention, there is provided the liquid jetting head including the heating elements for heating a liquid held in the liquid chamber, and the semiconductor devices for driving the heating elements. The heating elements and the semiconductor devices are integrally formed on a substrate. A droplet of the liquid is jetted from a predetermined nozzle by driving the heating element by the semiconductor device. A part of the inter-layer insulation film disposed on the semiconductor devices is formed of the coating type insulation film, whereby it is possible to prevent the generation of steps by providing the SOG film, and to increase the adhesion between a resin layer and a nozzle sheet. In addition, according to the one aspect of the present invention, the coating type insulation film is formed by repeating, at least a plurality of times, the treatment for building up a coating type insulating material film by application to the surface of the substrate, and the treatment for substantially removing the coating type insulation film in the heating element forming region, whereby it is possible to prevent the deterioration of the heating elements even in the case of preventing the generation of steps by providing the SOG film.

In accordance with the another aspect and the further aspect of the present invention, it is possible to provide a liquid jetting apparatus and a method of manufacturing the liquid jetting head by which it is possible to prevent the deterioration of the heating elements even in the case of preventing the generation of steps by providing the SOG film.

BRIEF DESCRIPTION OF THE DRAWINGS

The above and other objects, features and advantages of the present invention will become apparent from the following description and appended claims, taken in conjunction with the accompanying drawings, in which:

DESCRIPTION OF THE PREFERRED EMBODIMENTS

Figure 1A:
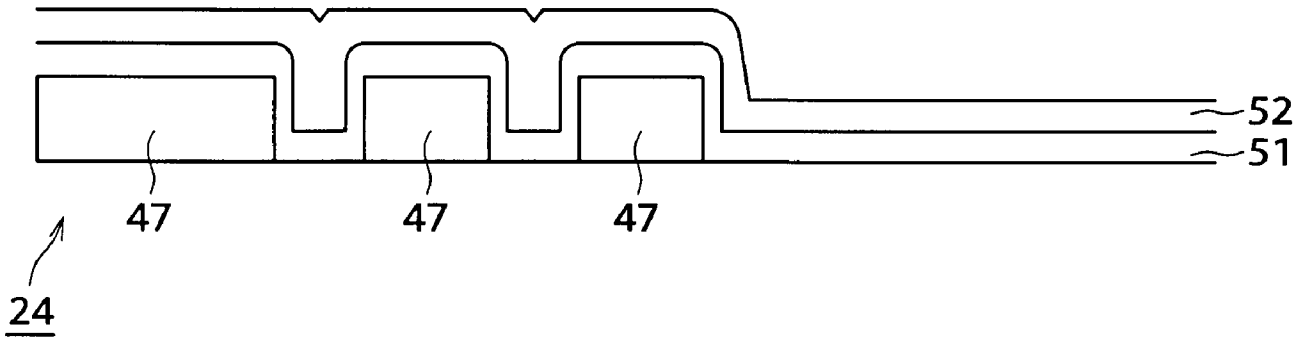
FIGS. 1A and 1B are sectional views for illustrating a step of forming an inter-layer insulation film in a head assembly applied to a line printer according to a first embodiment of the present invention.

Now, embodiments of the present invention will be described in detail below, referring to the drawings as required.

First Embodiment (1) Configuration of Embodiment

Figure 2:
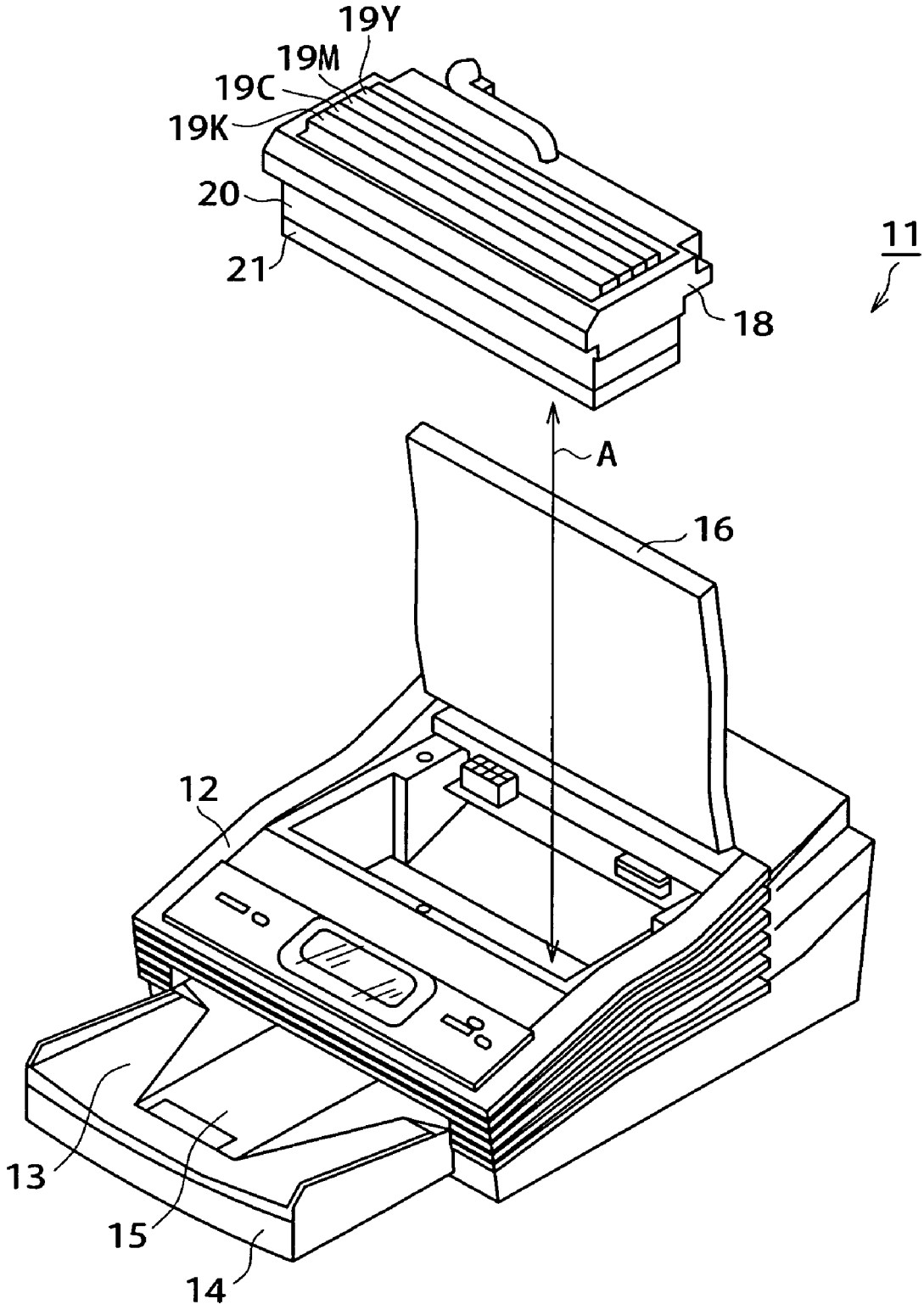
FIG. 2 is a perspective view showing the line printer according to the first embodiment of the present invention.

FIG. 2 is a perspective view showing a line printer according to the present invention. The line printer 11 is a full line type line printer, comprising a roughly rectangular printer main body 12. The line printer 11 is so configured that a paper tray 14 containing a paper 13 as a printing object is mounted through a tray entrance formed in a front surface of the printer main body 12, whereby the paper 13 can be supplied.

In operation of the line printer 11, when the paper tray 14 is mounted in the printer main body 12 via the tray entrance, the paper 13 is fed out from the paper tray 14 toward the back side of the printer main body 12 by rotation of a paper supply roller provided in the printer main body 12, and the feeding direction of the paper 13 is switched to the front surface direction by a reversion roller provided on the back side of the printer main body 12. In the line printer 11, the paper 13 whose feeding direction has been switched to the front surface direction is so fed as to cross over the paper tray 14, and is discharged into a tray 15 via a discharge port disposed on the front surface side of the line printer 11.

In the line printer 11, an upper lid 16 is provided on a top end surface, and a head cartridge 18 is replaceably disposed on the inside of the upper lid 16 and at an intermediate position of a paper feeding passage toward the front surface direction, as indicated by arrow A.

Here, the head cartridge 18 is a full line type printer head using four colors, i.e., yellow, magenta, cyan, and black, and individual color ink tanks 19Y, 19M, 19C, and 19K are provided on the upper side. The head cartridge 18 is composed of a head assembly 20 which is an assembly of printer head concerning the ink tanks 19Y, 19M, 19C, 19K, and a head cap 21 which, in off-use time, closes a nozzle array provided in the head assembly 20 so as to prevent the inks from drying. Thus, in the line printer 11, the head assembly 20 provided in the head cartridge 18 is driven to deposite individual color ink droplets onto the paper 13, whereby a desired image or the like can be printed in colors.

Figure 3:
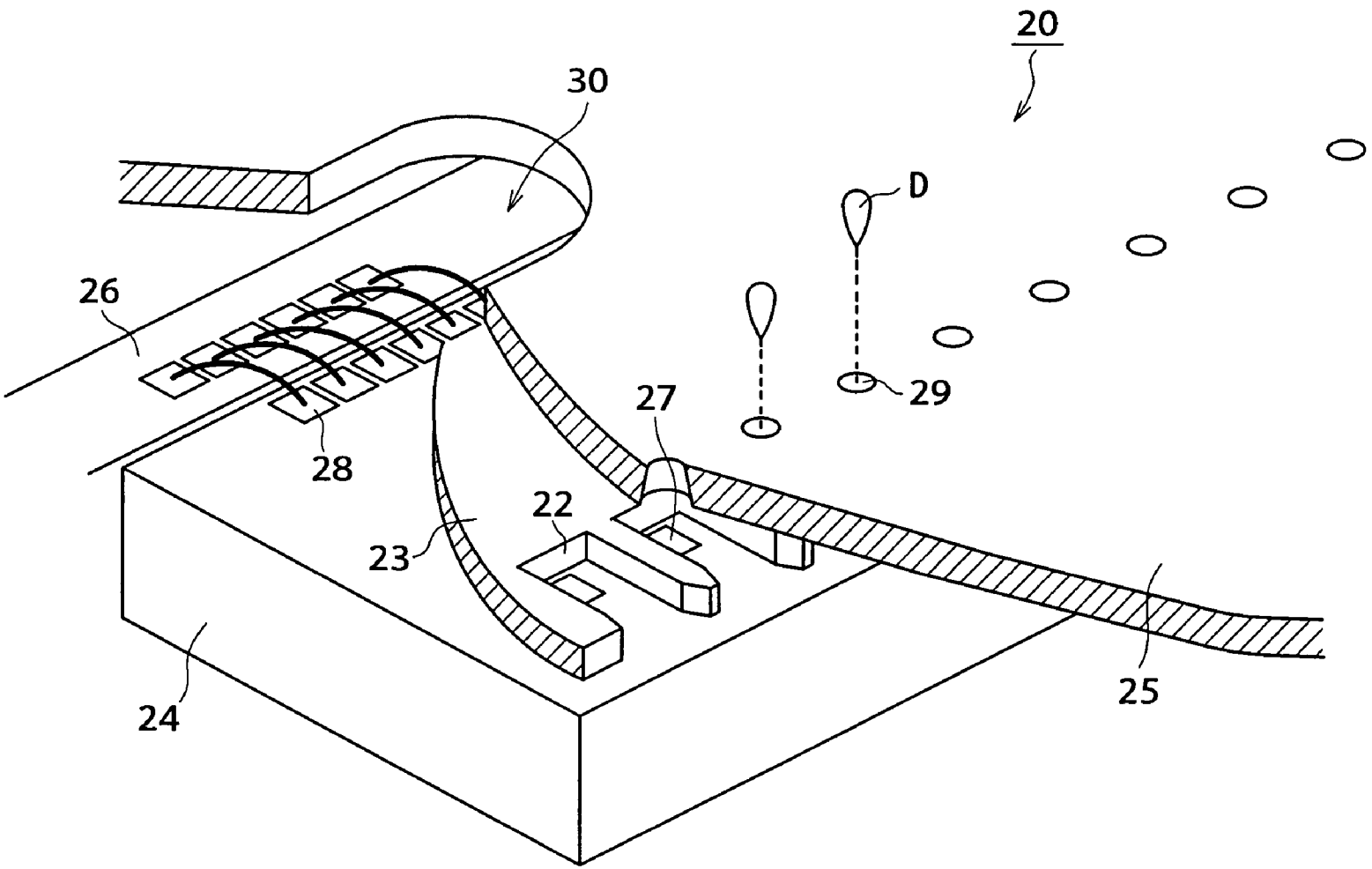
FIG. 3 is a perspective view showing, in an enlarged state, portions concerning the jetting of ink droplets, of the head assembly shown in FIG. 2.

FIG. 3 is a partly sectional perspective view showing, in an enlarges state, the portions concerning the jetting of the ink droplets D of the head assembly 20, as viewed from the side of the paper 13. The head assembly 20 is produced by a method in which head chips 24 provided with a partition wall 23 for the ink liquid chambers 22 and the like are sequentially adhered to a head frame, and the head chips 24 are wired through bonding terminals 26.

The head chip 24 comprises a plurality of heating elements 27, a drive circuit for driving the plurality of heating elements 27, a pad 28 for inputting power source to be supplied for driving of the drive circuit, and the like, is formed in a rectangular overall shape as viewed from the side of a nozzle sheet 25, with the plurality of heating elements 27 being disposed at a predetermined pitch along one of the long sides of the rectangular shape.

The head chip 24 has a structure in which the partition walls 23 for the ink liquid chambers 22 are formed in a comb teeth shape so as to be opened on one side, whereby ink conduits are formed on the one side, and the inks in the corresponding ink tanks 19Y, 19M, 19C, 19K can be led into the individual ink liquid chambers 22 via the ink conduits, and the inks thus introduced into the ink liquid chambers 22 can be heated by driving the heating elements 27.

The head chip 24 comprises the partition walls 23 which are formed by a method in which, in the stage of a semiconductor wafer, an exposure-curable dry film resist is laminated on side surfaces of the heating elements 27, and then the portions of the ink liquid chambers of the dry film resist and the like are removed by photolithographic process.

On the other hand, the nozzle sheet 25 is a sheet form member provided with an array of nozzles 29 according to the paper widths corresponding respectively to yellow, magenta, cyan, and black inks, and is formed by an electroforming technique. The nozzle sheet 25 is provided with an operating opening 30 for wire bonding the individual head chips 24 respectively to the bonding terminals 26 in a staggered pattern, with the array of the nozzles 29 therebetween.

Figure 4:
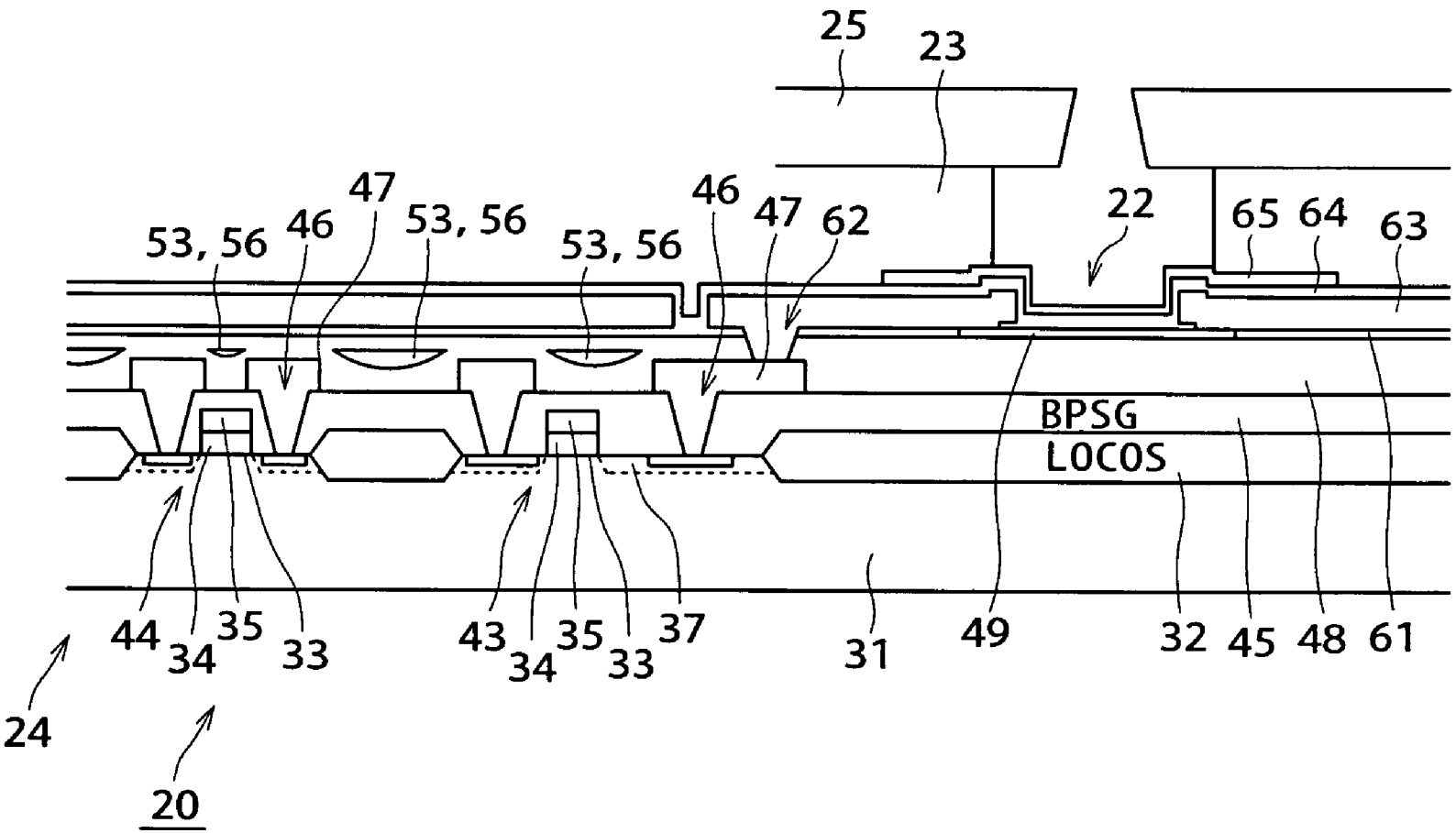
FIG. 4 is a sectional view showing the portions concerning the jetting of ink droplets, of the head assembly shown in FIG. 2.

FIG. 4 is a sectional view showing the configuration in the vicinity of the head chip disposed in the head assembly 20. The head chip 24 is produced by a method in which portions corresponding to a plurality of chips are collectively formed on a semiconductor wafer using a silicon substrate by a semiconductor production process, and the portions are divided into the chips by scribing.

Figure 5A:
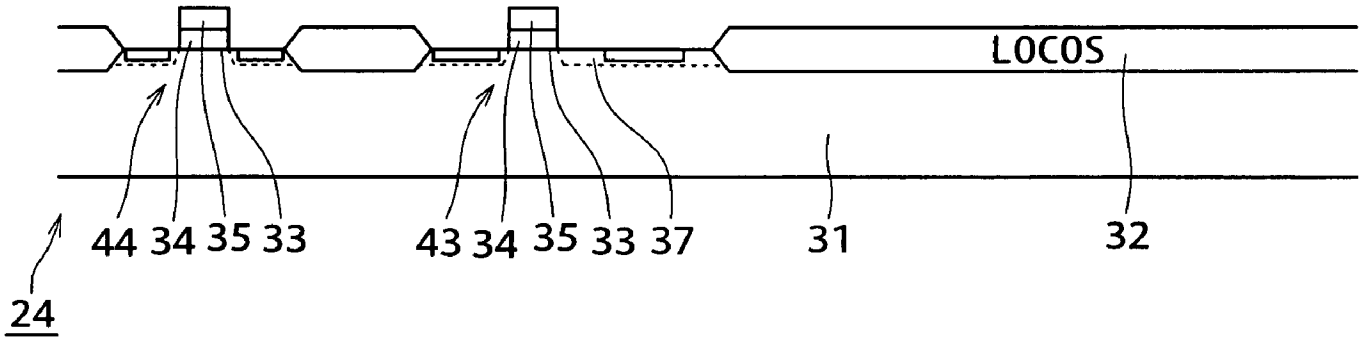
FIGS. 5A and 5B are sectional views for illustrating a step of forming a head chip shown in FIG. 4.

Specifically, as shown in FIG. 5A, in the manufacture of the head chip 24, a silicon substrate 31 composed of a wafer is cleaned, and then a silicon nitride film ($Si_3N_4$) is built up thereon. Subsequently, in the manufacture of the head chip 24, the silicon substrate 31 is treated by a photolithographic step and a reactive ion etching step, whereby the nitride film is removed from other regions than predetermined region in which to form the transistors. As a result, the head chip 24 is provided with the silicon nitride film on the silicon substrate 31 in the regions in which to form the transistors.

Subsequently, in the manufacture of the head chip 24, a thermal silicon oxide film is formed in a film thickness of 500 nm in the regions deprived of the silicon nitride film, by a thermal oxidation step, and device separation regions (LOCOS: Local Oxidation Of Silicon) 32 for separating the transistors by a thermal silicon oxide film are formed. Incidentally, the device separation regions 32 are finally formed in a film thickness of 260 nm by the subsequent treatment.

Followingly, in the production of the head chip 24, the silicon substrate 31 is cleaned, then a thermal oxide film for gates is formed in the transistor forming regions, followed by a cleaning treatment, and a polysilicon is built up to a film thickness of 100 nm by a CVD (Chemical Vapor Deposition) process. Subsequently, a tungsten silicide film is built up to a film thickness of 100 nm by a CVD process using a $WF_6$+$SiH_4$ based gas or a $WF_6$+$SiH_2C_{12}$ based gas. Incidentally, the tungsten silicide film can be formed by a sputtering process. Further, the gate regions are exposed by a lithographic step, and dry etching is conducted using an SF6+HBr based mixture gas to remove the surplus portions of the thermal oxide film, the polysilicon film, and the tungsten silicide film, whereby gate electrodes of a polycide structure composed of a gate oxide film 33, a polysilicon film 34, and a tungsten silicide film 35 are formed. In this embodiment, the gate length is not more than 2 μm.

Subsequently, the silicon substrate 31 is treated by an ion injection step and a heat treatment step, to form a low-concentration diffusion layer 37, and the silicon substrate 31 is further treated by an ion injection step and a heat treatment step for forming source and drain regions, whereby MOS type transistors 43, 44 are produced. Here, the low-concentration diffusion layer 37 is an electric field moderating layer for securing voltage resistance between gate and drain. In addition, the switching transistor 43 is an MOS type driver transistor having a voltage resistance of about 25 V, and is served to driving of the heating element. On the other hand, the switching transistor 44 is a transistor constituting an integrated circuit for controlling the driver transistor 43, and operates under a voltage of 5 V.

Figure 5B:
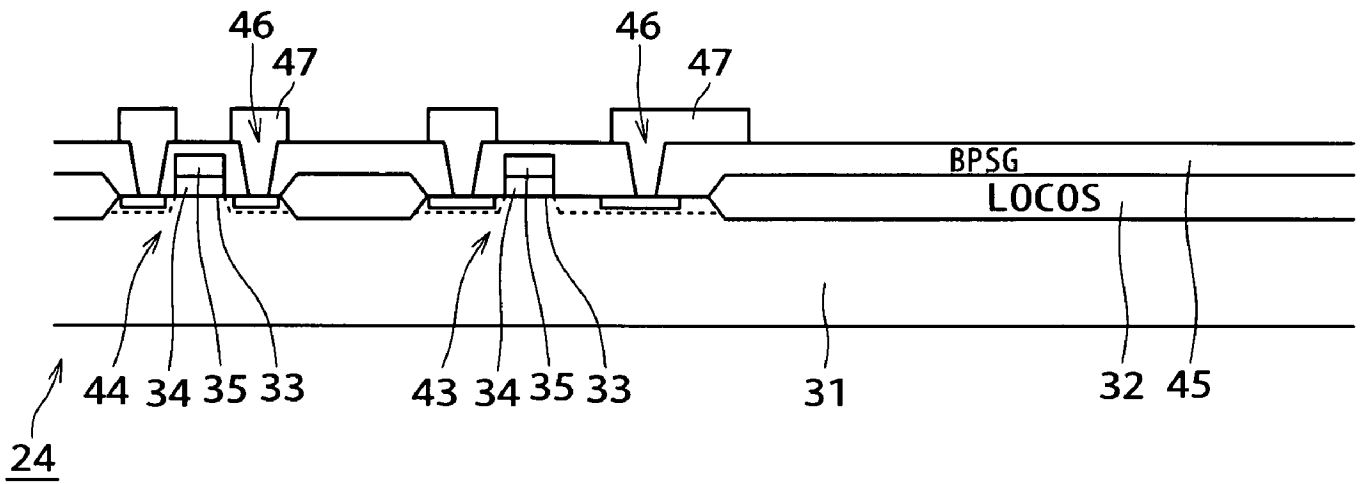

In the production of the head chip 24, as shown in FIG. 5B, an NSG (Non-doped Silicate Glass) film composed of a silicon oxide film and a BPSG (Boron Phosphorus Silicate Glass) composed of a silicon oxide film doped with boron and phosphorus are sequentially formed in film thicknesses of 100 nm and 500 nm, by a CVD process, whereby the first layer of inter-layer insulation film 45 with an overall film thickness of 600 nm is formed.

Subsequently, contact holes 46 are formed on a silicon semiconductor diffusion layer (source/drain) by a reactive ion etching process using $C_4F_8$/CO/$O_2$/Ar based gas.

Further, in the production of the head chip 24, a natural oxide film is removed from the surfaces of the silicon semiconductor diffusion layer exposed via the contact holes 46 by washing with diluted fluorohydric acid, and thereafter a titanium film having a film thickness of 30 nm, a titanium oxynitride barrier metal film having a film thickness of 70 nm, a titanium film having a film thickness of 30 nm, and a aluminum film with 1 at % of silicon added thereto or an aluminum film with 0.5 at % of copper added thereto having a film thickness of 500 nm are sequentially built up by the sputtering process. Subsequently, in the production of the head chip 24, titanium oxynitride film serving as a reflection preventive film is built up in a film thickness of 25 nm, whereby a film of a wiring pattern material is formed.

Followingly, a photolithographic step and a dry etching step are conducted to selectively removing the film of the wiring pattern material, thereby forming the first layer of wiring pattern 47. In the head chip 24, the MOS type transistors 43 for constituting the drive circuit are connected by the first layer of wiring pattern 47 thus formed, thereby forming a logic integrated circuit.

Figure 6:
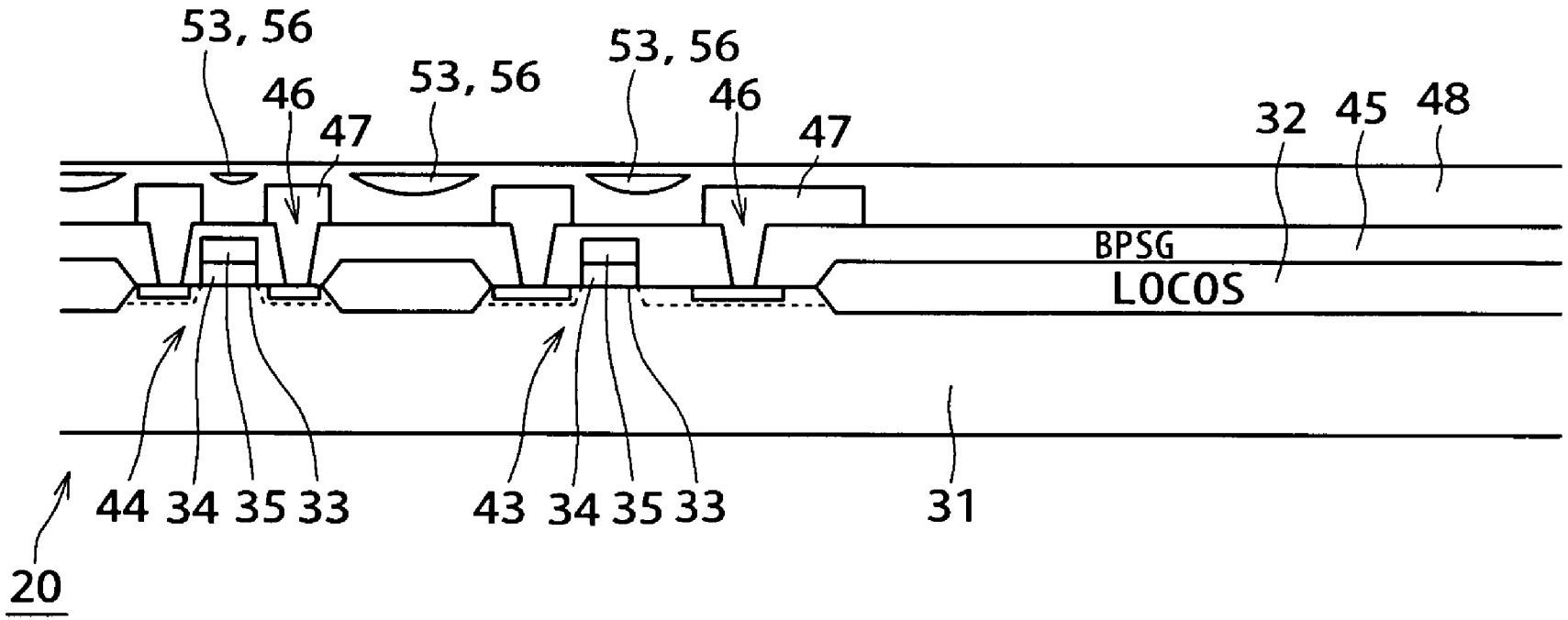
FIG. 6 is a sectional view showing a step subsequent to the step shown in FIG. 5B.

In the manufacture of the head chip 24, next, as shown in FIG. 6, a CVD process using TEOS (tetraethoxysilane: $Si(OC_2H_5)_4$) as a raw material gas is conducted to build up a silicon oxide film (hereinafter referred to as TEOS film) serving as the inter-layer insulation film, and an SOG film is formed at portions of steps generated due to the wiring pattern 47 is further formed, whereby the second layer of inter-layer insulation film 48 for insulation between the first layer of wiring pattern 47 and the subsequent second layer of wiring pattern is formed.

Here, in this embodiment, the building-up of the TEOS film and the formation of the SOG film are repeated a plurality of times, whereby the inter-layer insulation film 48 is formed. In the formation of the SOG film, to ensure that the SOG film is not left in the regions in which to form the heating elements, etching by dry etching is conducted until the TEOS film at the lower layer is exposed. Incidentally, in this embodiment, any of inorganic SOG containing silica glass as a main component, organic SOG containing an alkylsiloxane polymer as a main component, organic SOG containing an alkylsilsesquioxane polymer as a main component, and inorganic SOG containing a hydrogenated silsesquioxane polymer as a main component is used as the coating type insulating material, and a $CHF_3$/$CF_4$/Ar gas is applied to the dry etching. Besides, a low dielectric constant material containing a polyaryl ether as a main component may also be applied as the coating type insulating material.

Specifically, as shown in FIG. 1A, in the head chip 24, the first layer of TEOS film 51 is built up to a film thickness of 400 nm. Further, the first layer of insulating material film 52 is built up in a film thickness of 590 nm by applying a coating type insulating material by the spin coating process, whereby the film thickness of the insulating material film 52 at portions of steps is greater than that at other portions than the steps.

Figure 1B:
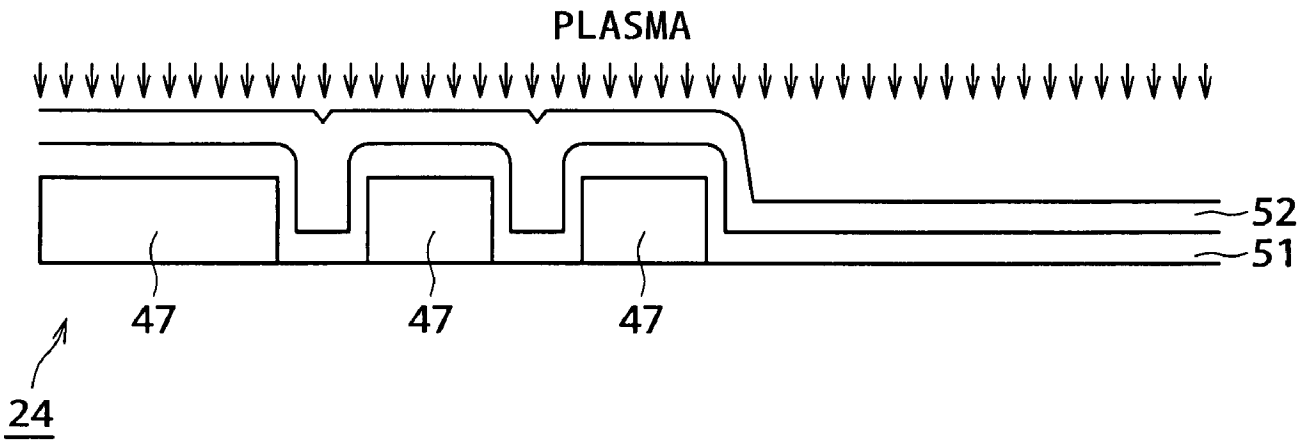
Figure 7A:
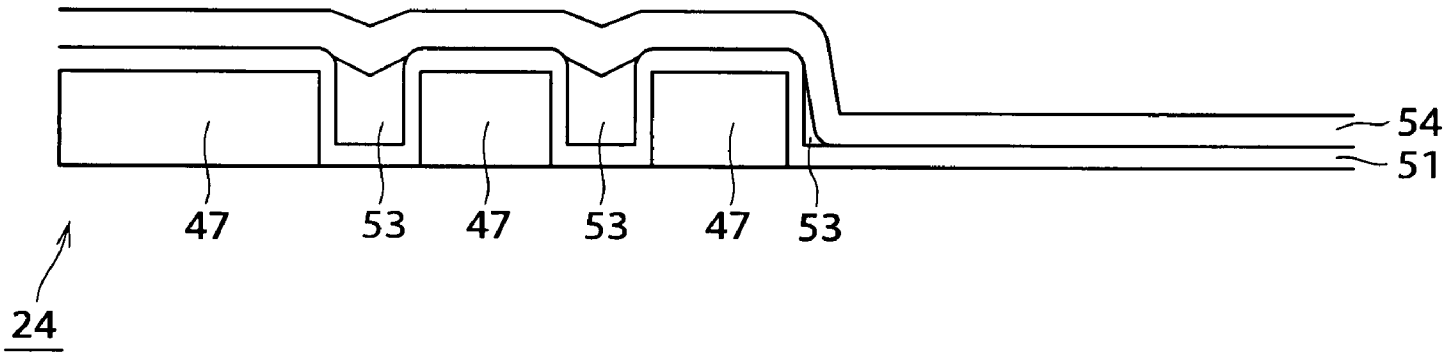
FIGS. 7A and 7B are sectional views showing steps subsequent to the step shown in FIG. 1B.

Subsequently, as shown in FIG. 1B, the whole surface of the silicon substrate 31 is etched by a film thickness of 340 nm by a dry etching process using a mixed gas plasma. By the etching, as shown in FIG. 7A, the insulating material film 52 at the portions of the steps is left to form the first layer of SOG film 53, whereas the insulating material film 52 at other portions than the portion of the steps is completely removed, to expose the TEOS film 51 therebeneath.

Figure 7B:
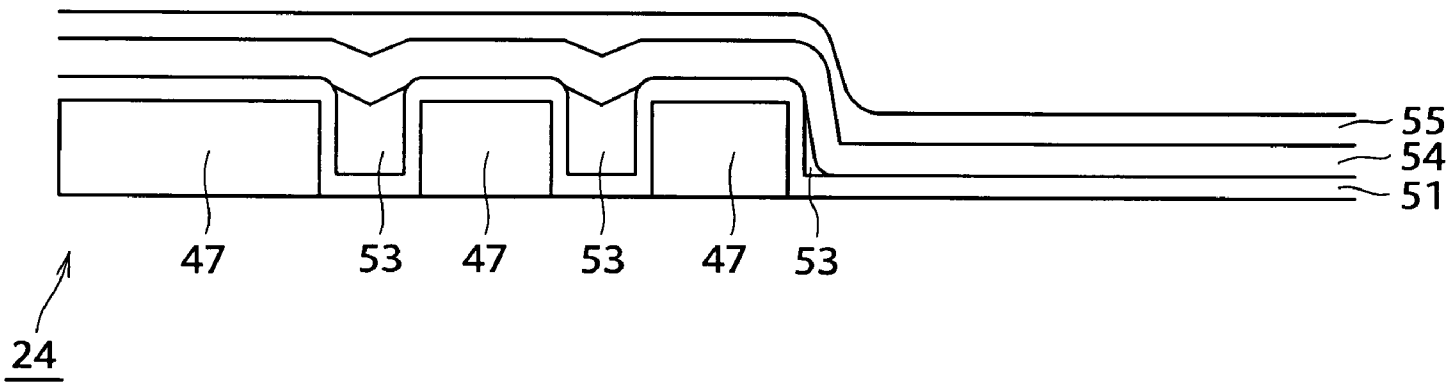
Figure 8A:
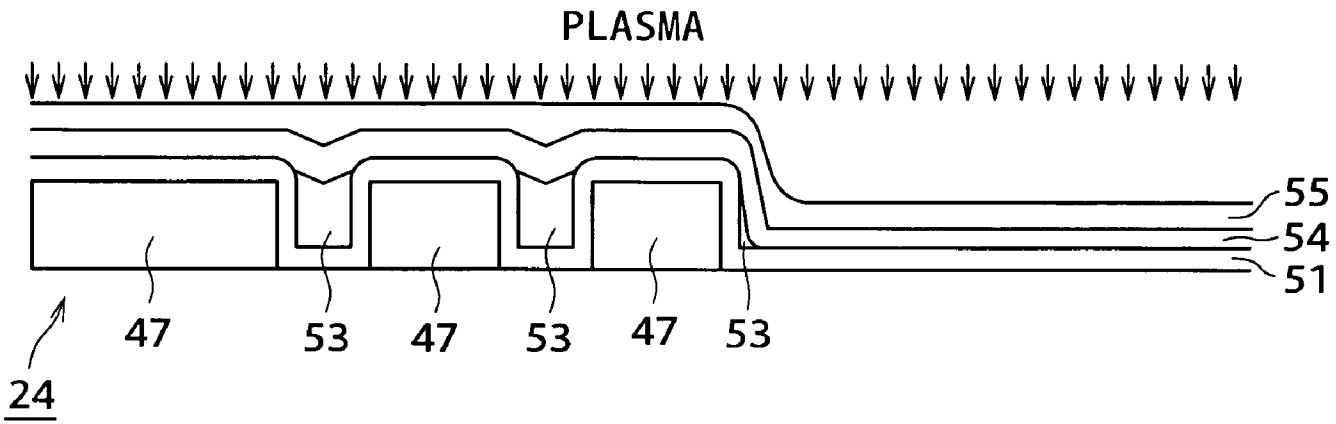
FIGS. 8A and 8B are sectional views showing steps subsequent to the step shown in FIG. 7B.
Figure 8B:
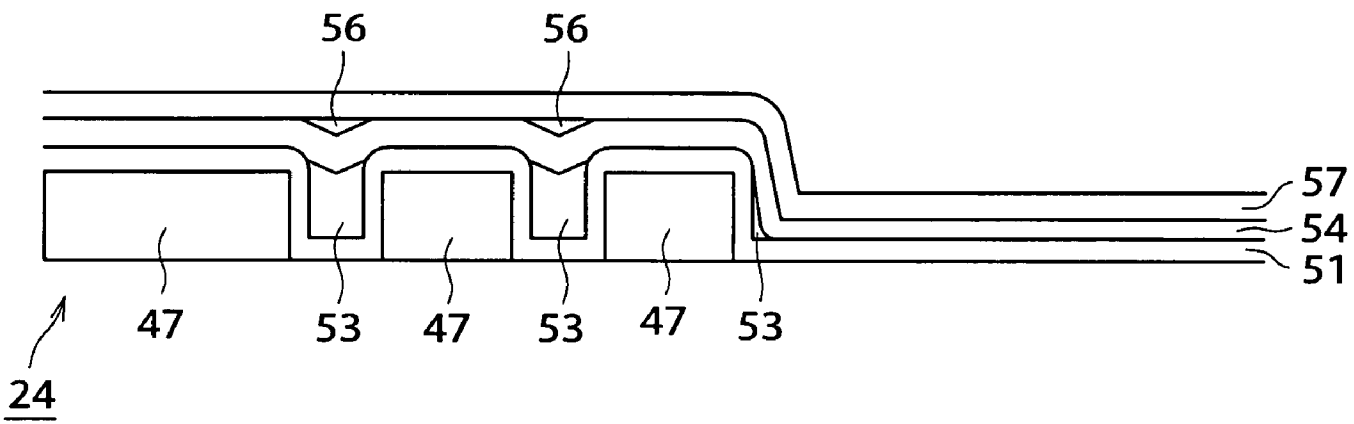

Followingly, the second layer of TEOS film 54 is built up in a film thickness of 300 nm, and the second layer of insulating material film 55 is built up in a film thickness of 590 nm, as shown in FIG. 7B. Further, as shown in FIG. 8A, the whole surface of the silicon substrate 31 is etched by a film thickness of 540 nm by a dry etching process using a mixed gas plasma, whereby the second layer of SOG film 56 is formed on the portions of the steps left due to the first layer of SOG film 53, as shown in FIG. 8B.

In the head chip 24, subsequently, the third layer of TEOS film 57 is built up in a film thickness of 300 nm, whereby an inter-layer insulation film 48 with parts of the TEOS films 51, 54, 57 flattened by the SOG films 53, 56 is formed in an overall film thickness of 440 nm.

In this embodiment, the treatment for building up the coating type insulating material film and the treatment for substantially removing the insulating material film in the forming regions of the heating elements by etching are repeated twice, whereby the generation of steps is prevented by the SOG films even in the case where the thickness of the steps concerning the wiring pattern 47 is large; besides, the insulating material films 52, 55 in the forming regions of the heating elements are securely removed, thereby preventing the heating elements from being deteriorated.

In addition, in the etching served to form such an SOG film, dry etching is used, whereby shortcircuit of the wiring patterns or the like due to the presence of an overhang generated in the case of using wet etching can be obviated effectively.

Incidentally, in the head assembly 20 according to this embodiment, the inter-layer insulation film 48 having a film thickness of 440 nm, the inter-layer insulation film 45 having a film thickness of 600 nm, and the device separation regions 32 having a film thickness of 260 nm, which are formed in the forming regions of the heating elements are utilized as a heat accumulation layer having a film thickness of 1.3 μm for accumulating the heat of the heating elements, whereby the inks can be heated efficiently.

Subsequent to such formation of the inter-layer insulation film 48 in the production of the head chip 24, a β-tantalum film is built up in a film thickness of 50 to 100 nm by a sputtering apparatus, whereby a resistor film is formed on the silicon substrate 31. Incidentally, the sputtering conditions were a wafer heating temperature of 200 to 400 degrees, a DC impressed power of 2 to 4 kW, and an argon gas flow rate of 25 to 40 sccm. Subsequently, in the production of the head chip 24, a photolithographic step and a dry etching step using a $BCl_3/Cl_2$ gas are conducted to selectively remove the resistor film in a square shape or in a bent-back shape with the one-side ends connected by the wiring pattern, whereby the heating elements 27 having a resistance of 40 to 100 Ω are formed.

In the head chip 24, subsequently, as shown in FIG. 4, a silicon oxide film having a film thickness of 300 nm is built up by a CVD process, to form an insulating protective layer 61 for the heating elements 27. Followingly, a photoresist step and a dry etching step using a $CHF_3/CF_4/Ar$ gas are conducted to remove the silicon oxide film at predetermined locations, whereby the portions for connecting the heating elements 27 to the wiring pattern are exposed. Further, a dry etching step using a $CHF_3/CF_4/Ar$ gas is conducted to provide the inter-layer insulation film 48 with openings, to form via holes 62.

Further, in the head chip 24, a titanium layer having a film thickness of 200 nm, and an aluminum layer with 1 at % of silicon added thereto or an aluminum layer with 0.5 at % of copper added thereto having a film thickness of 600 nm are sequentially built up by a sputtering process. Subsequently, in the head chip 24, a titanium oxynitride layer having a film thickness of 25 nm is built up, to form a reflection preventive layer. By these operations, in the head chip 24, a wiring pattern material layer composed of aluminum with silicon or copper added thereto is formed.

Subsequently, a photolithographic step and a dry etching step using a BCl3/Cl2 gas are conducted to selectively remove the wiring pattern material layer, to form the second layer of wiring pattern 63. In the head chip 24, a power source wiring pattern and an earth wiring pattern are formed of the second layer of wiring pattern 63, and a wiring pattern is formed for connection of the driver transistors 42 to the heating elements 27. Incidentally, the silicon nitride film 61 left on the heating elements 27 functions as a protective layer for protecting the heating elements 27 from chlorine radicals served to etching, in the etching step for forming the wiring pattern. Besides, in the silicon nitride film 61, the portions exposed to the chlorine radicals in the etching step are reduced in film thickness from 300 nm to 100 nm.

Followingly, in the head chip 24, a silicon nitride film 64 for functioning as an ink protective layer and an insulation layer is built up in a film thickness of 200 to 400 nm by a plasma CVD process. Further, in a heat treatment furnace, a heat treatment is conducted at 400 degrees for 60 min in a nitrogen gas atmosphere with 4% of hydrogen added thereto or in a 100% nitrogen atmosphere. This ensures that, in the head chip 24, the operations of the transistors 43 and 44 are stabilized, and the connection between the first layer of wiring pattern 47 and the second layer of wiring pattern 63 is stabilized, whereby contact resistance is reduced.

In the head chip 24, subsequently, an anti-cavitation material layer is built up in a film thickness of 100 to 300 nm, and the anti-cavitation material layer is subjected to pattering by use of a $BCl_3/Cl_2$ gas, to form an anti-cavitation layer 65. In this embodiment, an anti-cavitation layer 65 formed of β-tantalum is formed by a DC magnetron sputtering apparatus using tantalum as a target. Here, the anti-cavitation layer 65 is a protective layer for protecting the heating element 27 by absorbing the physical damage (cavitation) at the time of extinction of a bubble generated in the ink liquid chamber 22 by the driving of the heating element 27, or for protecting the heating element 27 from the chemical action of the ink heated to a high temperature by the driving of the heating element 27.

Subsequently, in the head chip 24, a photosensitive organic resin is applied, of which the portions corresponding to the ink liquid chambers 22 and the ink conduits are removed by exposure and development steps, then the remaining organic resin is cured, to form the partition walls 23 of the ink liquid chambers 22, the partition walls 23 of the ink conduits, etc. The head chip 24 is formed by scribing a plurality of head chip portions formed on the silicon substrate 31 in the above-mentioned manner.

(2) Operations of Embodiment

In the line printer 11 (FIG. 2) configured as described above, the head cartridge 18 is driven by image data, text data, etc. served to printing, then, while the paper 13 as a printing object is fed by a predetermined paper feeding mechanism, ink droplets are jetted from the head assembly 20 provided in the head cartridge 18, and the ink droplets adheres to the paper 13 being fed, whereby an image, a text or the like is printed. Correspondingly to this, in the head assembly 20 of the head cartridge 18 (FIGS. 2 and 3), the inks in the ink tanks 19Y, 19M, 19C, 19K are led into the ink liquid chambers 22 in the head chip 24, and the inks in the ink liquid chambers 22 are heated by the driving of the heating elements 27, whereby ink droplets D are jetted from the nozzles 29 provided in the nozzle sheet 25. By these operations, in the line printer 11, a predetermined image or the like can be printed.

The head assembly 20 is produced by arranging the head chip 24 (FIGS. 4-6) provided with the plurality of heating elements 27, the transistors 43 for driving the heating elements 27, the transistors 44 constituting an integrated circuit for controlling the transistors 43, etc., and the nozzle sheet 25 which is a sheet-like member provided with the nozzle array of the nozzles 29 for jetting the ink droplets and the opening 30 by electroforming (FIG. 3). The nozzle array composed of the nozzles 29 is formed along the paper width of the printing object, whereby a full line type line head is configured, which can print desired images and the like at a higher speed, as compared with the case of a printer head having a serial head.

Figure 9:
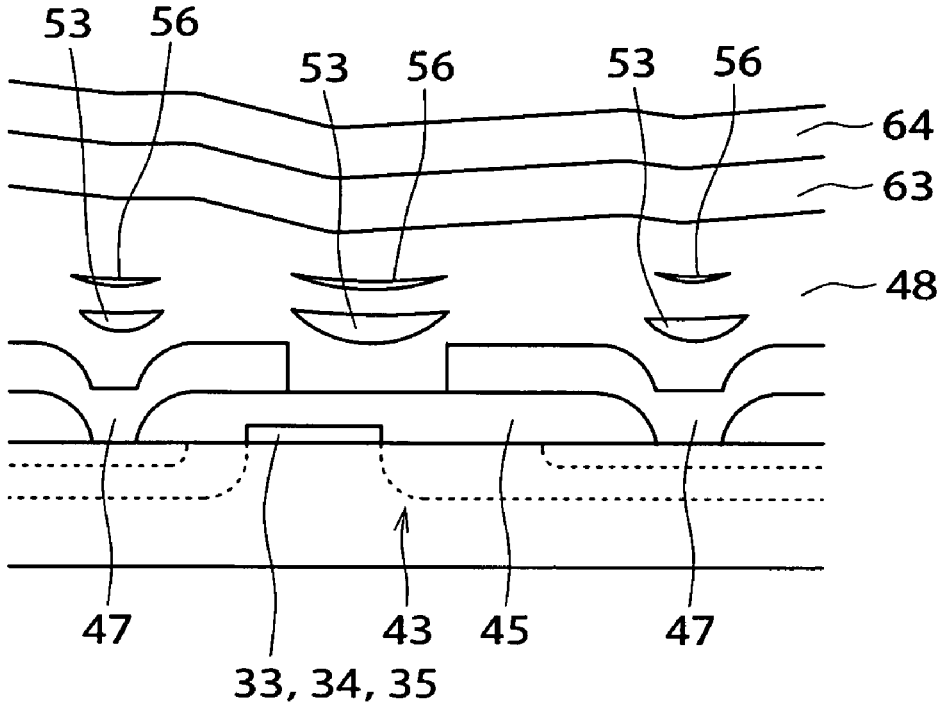
FIG. 9 is a sectional view showing a portion concerning steps in an inter-layer insulation film formed by the forming step of FIGS. 1A and 1B.

In such a head assembly 20, as shown in FIG. 9, those parts of the inter-layer insulation film 48 disposed on the upper side of the transistors 43 which concern the steps generated due to the wiring pattern 47 are formed of the SOG film, and the SOG film flattens the surface of the inter-layer insulation film 48, so that the adhesion between the resin layer and the nozzle sheet 25 can be increased.

In the head assembly 20, with the SOG film thus used, there is a fear of deterioration of the heating elements 27. Specifically, in the line printer 11, if the SOG films 53, 56 are left on the lower side of the heating elements 27, the resistance of the heating elements 27 is raised also by the so-called no-load driving, with the result that the ink droplets D cannot be jetted stably.

In this embodiment, however, after the TEOS film 51 is built up, the coating type insulating material is applied to the substrate surface to build up the insulating material film 52, and the whole surface of the substrate 31 is etched until the TEOS film 51 in the forming regions of the heating elements 27 is exposed, whereby the insulating material film 52 in the forming regions of the heating elements 27 is securely removed. Furthermore, these steps are repeated a plurality of times to sequentially form the TEOS film 54, the SOG film 56, and the TEOS film 57, whereby the inter-layer insulation film 48 with its surface flattened is formed even where the steps due to the wiring pattern 47 have a large thickness (FIGS. 1 and 7-8). Accordingly, in the head assembly 20, deterioration of the heating elements 27 can be prevented even where the generation of steps is prevented by the SOG films.

Figure 10:
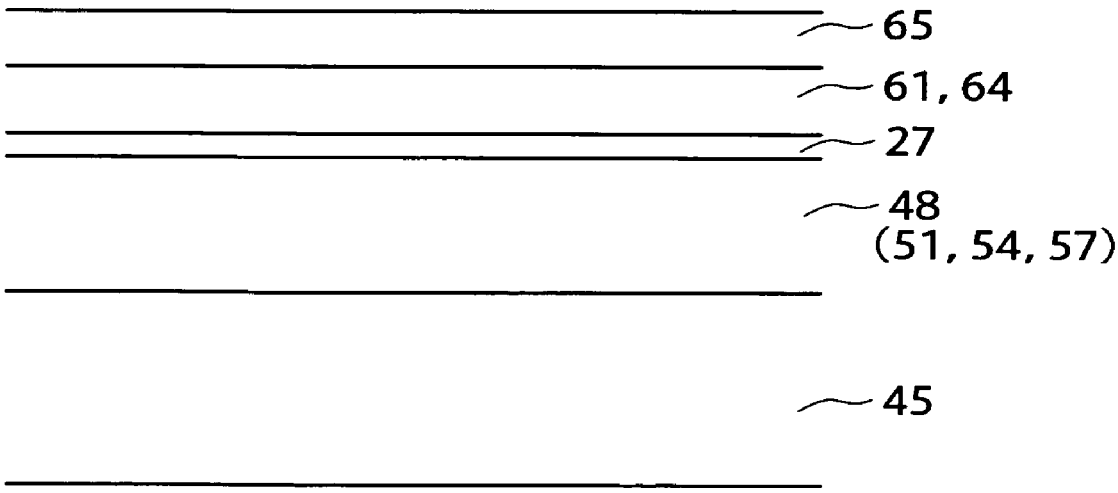
FIG. 10 is a sectional view for illustrating the vicinity of a heating element of the inter-layer insulation film formed by the forming step of FIGS. 1A and 1B.
Figure 11:
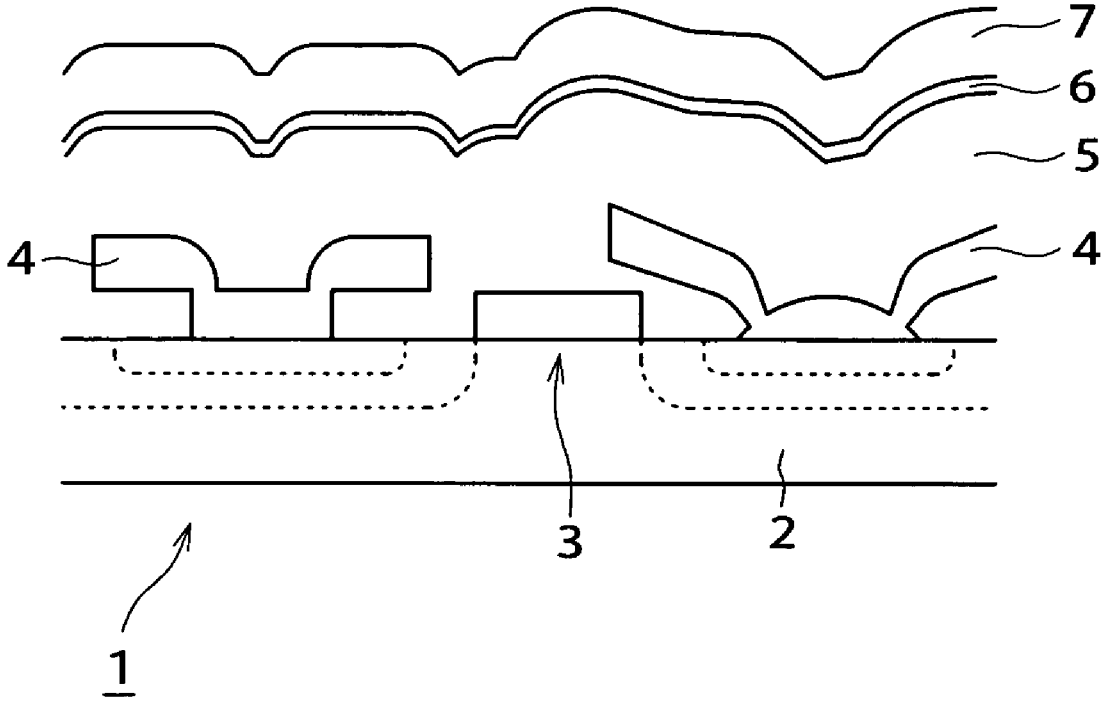
FIG. 11 is a sectional view showing the configuration in the vicinity of a transistor in a printer head according to the related art.
Figure 12:
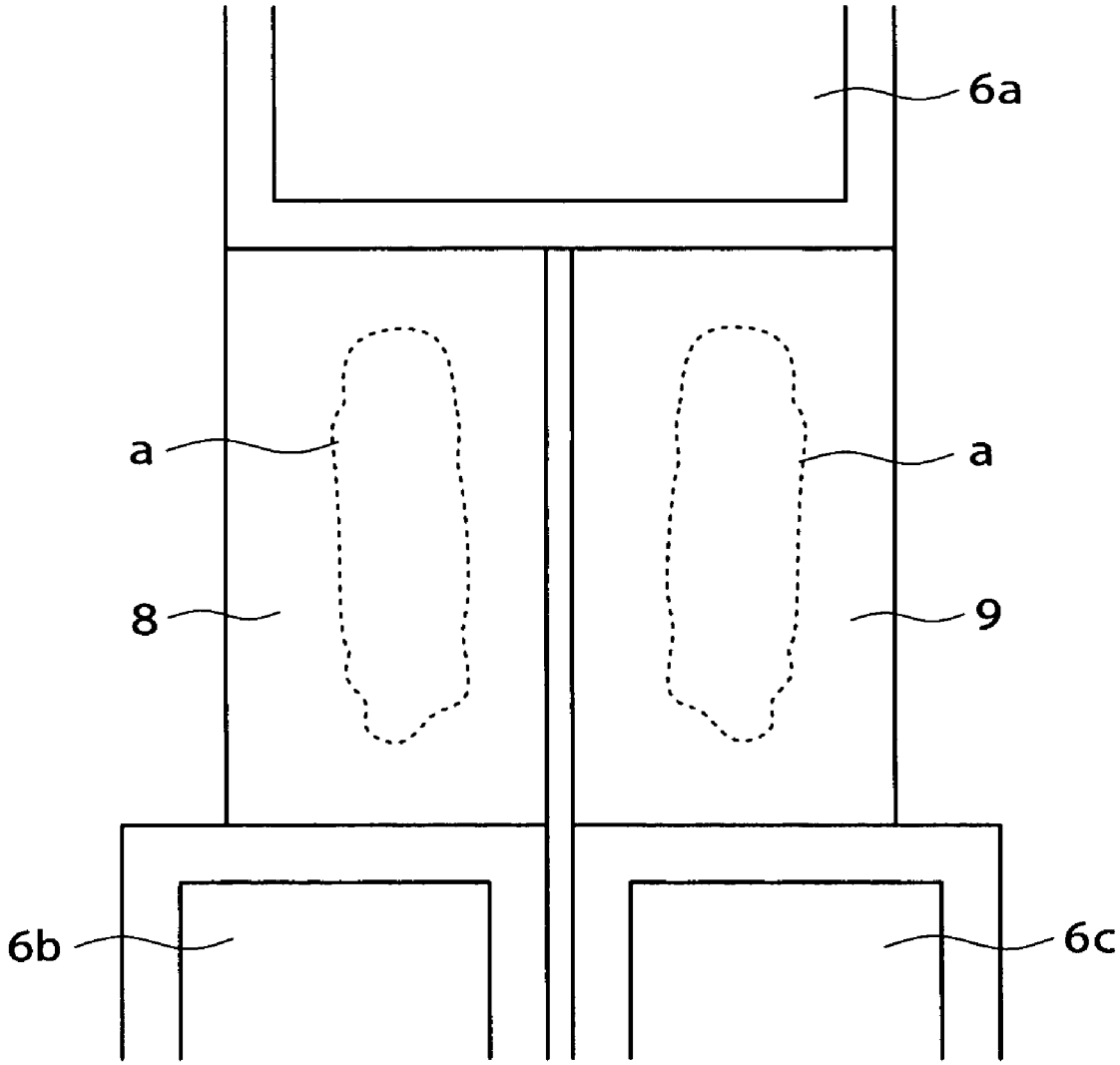
FIG. 12 is a plan view for illustrating deterioration of the heating element.

In practice, from the results of actual measurement of the resistance of the heating elements 27 by driving the above-mentioned head assembly 20, there were observed little variation in resistance. In addition, when the vicinity of the heating element 27 was observed under a scanning type electron microscope (SEM), as shown in FIG. 10, only the TEOS films 51, 54, 57 could be seen in the inter-layer insulation film 48, and it was confirmed that deterioration of the heating elements 27 can be prevented by securely removing the SOG films 53, 56.

In addition, when dry etching is used as the etching served to the formation of the SOG films 53, 56, it is possible to effectively obviate the shortcircuit of the wiring patterns or the like due to an overhang generated in the case of using wet etching.

(3) Effects of the Embodiment

According to the above-described configuration, by repeating, at least a plurality of times, the treatment for building up the coating type insulating material film and the treatment for substantially removing the insulating material film in the forming regions of the heating elements by etching, deterioration of the heating elements can be prevented even where the generation of steps is prevented by the SOG films.

Besides, since dry etching is used as the etching served to the formation of the SOG films, shortcircuit of the wiring patterns or the like due to an overhang generated in the case of using wet etching can be obviated effectively.

Second Embodiment

While the case of preventing the generation of steps by forming the SOG films by repeating twice the application of the coating type insulating material film and etching has been described in the above embodiment, the present invention is not limited to this mode; for example, the application of the coating type insulating material film and the etching may be repeated three times or more, and the same effects as in the above embodiment can be obtained by repeating the treatments at least a plurality of times.

In addition, while the case of securely removing the insulating material film in the forming regions of the heating elements has been described in the above embodiment, the present invention is not limited to this mode. The insulating material film may be left in the forming regions of the heating elements, within such a range that deterioration of the heating elements is not generated, whereby the same effects as in the above embodiment can be obtained by etching away the insulating material film to such an extent as to substantially remove the insulating material film in the forming regions of the heating elements.

Furthermore, while the case of forming the inter-layer insulation film by repeating the building-up of the TEOS film and the formation of the SOG film a plurality of times has been described in the above embodiment, the present invention is not limited to this mode. Namely, in the case of substantially removing the insulating material film in the forming regions of the heating elements, there may be widely adopted various modes such as a mode of building up the TEOS film and then repeating a plurality of times the formation of the SOG film at the portions of steps to form the inter-layer insulation film, a mode of repeating the formation of the SOG film at the portions of the steps a plurality of times and then building up the TEOS film to form the inter-layer insulation film, etc. Incidentally, when one of these modes is adopted, the formation of the inter-layer insulation film can be simplified, as compared with the above-described embodiment.

Besides, while the case of forming a part of the inter-layer insulation film for insulation between the wiring patterns from the SOG film has been described in the above embodiment, the present invention is not limited to this mode. Namely, there can be widely adopted various modes such as a mode of forming a part of the insulating protective layer composed of the silicon nitride film from the SOG film, a mode of forming a part of the inter-layer insulation film disposed on the transistors from the SOG film, etc.

In addition, while the case of forming four nozzle arrays by applying the present invention to a full line type printer head for color printing has been described in the above embodiment, the present invention is not limited to this mode. Namely, the present invention can be widely applicable to cases of various numbers of nozzle arrays, for example, the case of forming one nozzle array by applying the present invention to a full line type printer head for black-and-white printing.

Besides, while the case of applying the present invention to a printer or printer head used with paper as the printing object has been described in the above embodiment, the present invention is not limited to this mode. Namely, the present invention can be widely applied to printers or printer heads used with various materials as the printing object, for example, the case where a liquid, a dye or the like as a pattern forming material is jetted from the nozzles.

The present invention is not limited to the details of the above preferred embodiments. The scope of the invention is defined by the appended claims and all changes and modifications as fall within the equivalence of the scope of the claims are therefore to be embraced by the invention.

What is claimed is:

1. A liquid jetting head comprising:

heating elements for heating a liquid held in a liquid chamber;

a first plurality of semiconductor devices for driving said heating elements; and a second plurality of semiconductor devices for controlling said first plurality of semiconductor devices, wherein, said heating elements, said first plurality of semiconductor devices and said second plurality of semiconductor devices are integrally formed on a substrate, said first plurality of semiconductor devices and said second plurality of semiconductor devices formed in regions separated from each other by thermal film regions, said thermal film regions are formed in the forming regions of said heating elements to accumulate heat of said heating elements for improved heating of said liquid, and a droplet of said liquid is jetted from a predetermined nozzle by driving said heating element by said semiconductor, and a part of an inter-layer insulation film disposed on said first plurality of semiconductor devices and said second plurality of semiconductor devices is formed of a coating type insulation film, and said coating type insulation film is formed by repeating, at least a plurality of times, a treatment for building up a coating type insulating material film by application to the surface of said substrate, and a treatment for substantially removing said coating type insulating material film in said heating element forming region by etching the surface of said substrate.

2. A liquid jetting head as set forth in claim 1, wherein said etching is a dry etching.

3. A liquid jetting apparatus for supplying an object with droplets jetted from a liquid jetting head, said liquid jetting head comprises:

heating elements for heating a liquid held in a liquid chamber; and a first plurality of semiconductor devices for driving said heating elements; and a second plurality of semiconductor devices for controlling said first plurality of semiconductor devices, wherein said heating elements, said first plurality of semiconductor devices and said second plurality of semiconductor devices are integrally formed on a substrate, said first plurality of semiconductor devices and said second plurality of semiconductor devices formed in regions separated from each other by thermal film regions, said thermal film regions are formed in the forming regions of said heating elements to accumulate heat of said heating elements for improved heating of said liquid held in said liquid chamber, and said heating elements being driven by said first plurality of semiconductor devices to heat said liquid, thereby jetting droplets of said liquid through nozzles, and a part of an inter-layer insulation film disposed on said first plurality of semiconductor devices and said second plurality of semiconductor devices is formed of a coating type insulation film, and said coating type insulation film is formed by repeating, at least a plurality of times, a treatment for building up a coating type insulating material film by application to the surface of said substrate, and a treatment for substantially removing said coating type insulating material film in said heating element forming region by etching the surface of said substrate.

* * * * *